United States Patent [19]

Akutagawa et al.

[11] 4,327,685

[45] May 4, 1982

[54] AIR-FUEL INTAKE SYSTEM FOR INTERNAL COMBUSTION ENGINES

[75] Inventors: Kenichi Akutagawa, Kuroishi; Hitoshi Yoshida; Tadashi Hattori, both of Okazaki; Akira Takata; Tamotsu Fukuda, both of Toyota, all of Japan

[73] Assignees: Nippon Soken, Inc., Nishio; Toyota Jidosha Kogyo Kabushiki Kaisha, Toyota, both of Japan

[21] Appl. No.: 102,899

[22] Filed: Dec. 12, 1979

[30] Foreign Application Priority Data

Dec. 14, 1978 [JP] Japan ..... 53/155479

[51] Int. Cl.[3] ..... F02D 9/12

[52] U.S. Cl. ..... 123/402; 123/445; 261/44 D

[58] Field of Search ..... 123/52 R, 52 M, 52 MC, 123/33 T, 402, 403, 445; 261/44 D, 44 B

[56] References Cited

U.S. PATENT DOCUMENTS

| | | | |
|---|---|---|---|
| 1,151,286 | 8/1915 | Rowell | 261/44 D |
| 1,394,546 | 10/1921 | Chase | 261/44 D |
| 2,828,116 | 3/1958 | Bascle, Jr. | 261/44 D |
| 3,282,572 | 11/1966 | Karlovitz | 123/52 M |
| 4,186,708 | 2/1980 | Bowler | 123/445 |

*Primary Examiner*—Craig R. Feinberg

*Attorney, Agent, or Firm*—Cushman, Darby & Cushman

[57] ABSTRACT

An intake system for internal combustion engines comprises a throttling system mounted in an intake pipe between a fuel injection valve and an intake manifold, the throttling system including a stationary valve body fixed in the intake pipe in opposed relation with the injection valve and a hollow valve body mounted in the intake pipe for movement in the axial direction of the intake pipe. The hollow valve body has a downwardly converged inner wall surface surrounding the stationary valve body to define therebetween valve opening of variable opening area. The stationary valve body includes a frusto-conical portion and a cylindrical portion, of which lower edge is in the form of sinusoidal wave to cooperate with the hollow valve body in producing the valve opening of gradually increasing opening area.

14 Claims, 10 Drawing Figures

AIR-FUEL INTAKE SYSTEM FOR INTERNAL COMBUSTION ENGINES

BACKGROUND OF THE INVENTION

1. Field of the Invention

The present invention relates to generally an air-fuel intake system for the internal combustion engines and more particularly to an improvement of a throttling system thereof.

2. Description of the Prior Art

The conventional intake systems comprise in general a fuel supply means such as a carburetor and a fuel injection valve, an intake pipe, a butterfly type throttle valve disposed within the intake pipe, and an intake manifold for distributing the air-fuel mixture to the engine cylinders.

The intake systems of the type described above has a problem that the uniformity of air-fuel mixture distribution cannot be completely ensured so that the high and reliable engine performance and low pollutant emission cannot be ensured. The main cause of this problem is that the fuel supplied from the fuel supply means adheres to the wall surfaces of the intake pipe and forms the films. These fuel films flow along the intake manifold wall into the engine cylinders in varying quantities so that the air-fuel ratios of the combustion mixtures charged into the engine cylinders vary from one cylinder to another. The adhesion of the fuel to the wall surfaces and the resultant formations of the fuel films are in turn attributed to the fact that the fuel has not been satisfactorily atomized and uniformly mixed with the combustion air.

Another cause is attributed to the butterfly type throttle valve which is not positioned symmetrically with respect to the axis of the air-fuel passage so that non-uniform distributions or localized concentrations of the air-fuel mixtures result. In addition, the butterfly valve is so designed and arranged as to rotate, thereby varying the opening area so that the geometrical relationship between the butterfly type throttle valve and the fuel supply means changes from time to time depending upon the operating conditions of the engine and consequently the localized concentration of fuel are further enhanced.

SUMMARY OF THE INVENTION

In view of the above, one of the objects of the present invention is to provide an intake system for an internal combustion engine which may ensure the almost complete atomization of the fuel and the elimination of localized concentrations of the fuel so that the uniformity of the air-fuel mixture distribution may be ensured and consequently higher and more reliable engine performance may be obtained and the emission of pollutants may be substantially suppressed.

Another object of the present invention is to provide an intake system for an internal combustion engine that may ensure the smooth and optimum control of the flow rate of the air-fuel mixture over the whole range of the engine operations.

To the above and other ends, briefly stated, the present invention provides an intake system for an internal combustion engine wherein a stationary valve body is securely held in spaced and opposed relationship with a fuel supply means such as a fuel injection valve and a carburetor, and a movable hollow valve body (which interchangeably is referred to as "movable tubular body") is so arranged as to move with respect to the stationary valve body in the axial direction thereof in such a way that a part of the outside wall surfaces of the movable hollow valve body slides over the inside wall surface of the intake pipe in an air-tight intimate contact therewith and the inside wall surface of the movable hollow valve body cooperates with the stationary valve body to vary the opening area of the intake pipe, and wherein a ratio of the opening area defined by the outer circumferential surface of the stationary valve body and the inner wall surface of the movable tubular body to the area of the entire outer circumferential surface of the stationary valve body is varied dependent upon an axial displacement of the movable tubular body.

The above and other objects, features and advantages of the present invention will become more apparent from the following descriptions of the preferred embodiments thereof taken in conjunction with the accompanying drawings.

DESCRIPTION OF THE PREFERRED EMBODIMENTS

Figure 1:
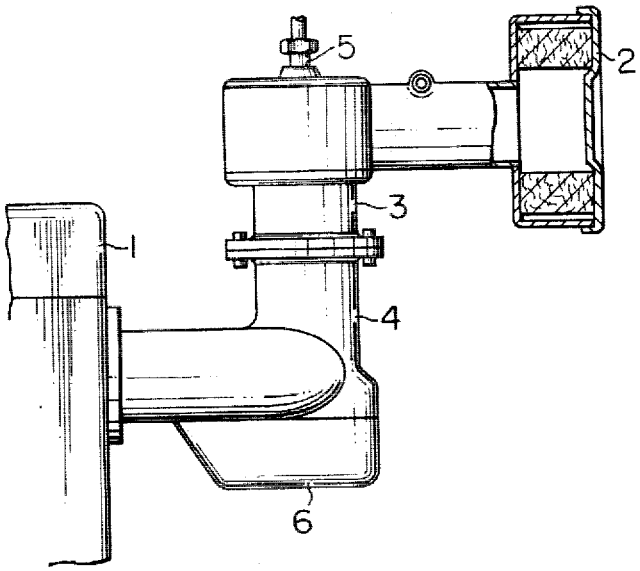
FIG. 1 is a side view of an embodiment of an intake system in accordance with the present invention.

FIG. 1 shows a first embodiment of the present invention. The combustion air is charged through an air cleaner 2, an intake pipe 3 and an intake manifold 4 into a four-cycle, ignition type, multicylinder automotive engine 1 of the conventional type. The fuel such as gasoline is charged into the intake pipe 3 and is mixed with the air before charged into the engine 1.

A heater 6 is mounted on the intake manifold 4 and the cooling water discharged from the engine 1 is circulating through the heater 6 as will be described in detail below, thereby heating the intake manifold 4.

The fuel such as gasoline is charged by a fuel supply means 5. The fuel is supplied under pressure from a fuel pump (not shown) and the quantity of the fuel to be injected is controlled or metered by the fuel supply means depending upon the operating conditions of the engine 1.

Next referring to FIG. 2, the intake pipe 3 and a throttling system 10 incorporated therein will be described in detail below. The intake pipe 3 comprises an upper half 31 and a lower half 32. The upper half 31 has an air horn 33 which extends toward (right in FIG. 2) and is connected to the air cleaner 2 and whose cross-sectional area is gradually reduced toward the air cleaner 2. The fuel supply means or fuel injection valve 5 is screwed into the top wall of the upper half 31. Four spring retainers or hangers 34 are depending from the top wall and are equiangularly spaced apart from each other.

The lower half 32 has a lower small-diameter portion 35 which defines the air-fuel mixture passage and an upper large-diameter portion 36 which is contiguous with the lower small-diameter portion 35 and is connected to the upper half 31.

Next the throttling system 10 will be described which includes a stationary valve body 11 and a movable tubular body 12. The stationary valve body 11 is suspended by means of four equiangularly spaced suspension rods 13 (only two is shown in FIG. 2) from the top wall of the upper half 31 in the air passage defined in the latter in spaced apart and opposed relationship with the fuel injection valve 5.

Figure 3:
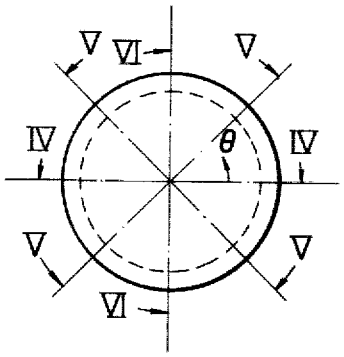
FIG. 3 is a plan view of a stationary valve body shown in FIG. 2.
Figure 4:
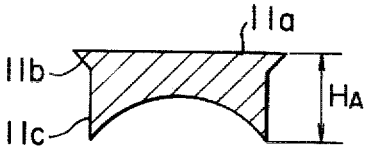
FIG. 4 is a sectional view taken along the line IV—IV in FIG. 3.
Figure 5:
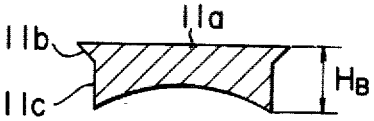
FIG. 5 is a sectional view taken along the line V—V in FIG. 3.
Figure 6:
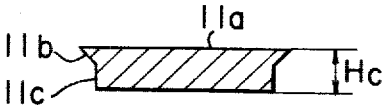
FIG. 6 is a sectional view taken along the line VI—VI in FIG. 3.
Figure 7:
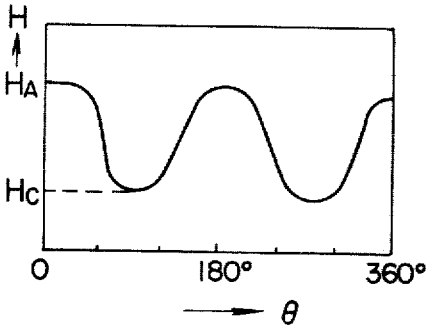
FIG. 7 is a developed view of the outer circumferential surface of the stationary valve body of FIG. 3.
Figure 9:
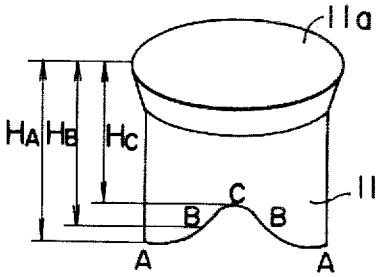
FIGS. 9 and 10 are perspective views of the stationary valve body shown in FIG. 2.
Figure 10:
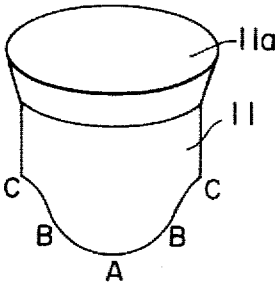

The stationary valve body 11 includes a flat top surface 11*a*, a frusto-conical portion 11*b* and a substantially cylindrical-shaped outer circumferential wall 11*c*. The axial length H of the outer circumferential wall 11*c* varies from $H_A$ to $H_B$ and from $H_B$ to $H_C$ in the circumferential direction, as shown in FIGS. 4 to 6 and in FIGS. 9 and 10. In FIG. 7, the axial length H of the outer circumferential wall is plotted versus and angle $\theta$ which is taken as shown in FIG. 3.

The movable tubular body 12 comprises a lower hollow cylindrical portion 12*a* and an upper flared or upwardly diverged portion 12*b* which defines, for instance, a frustoconical metering passage 18 which is coaxial with the stationary valve body 11. The lower cylindrical portion 12*a* of the tubular body 12 has a first or lower flange 14 formed at the lower open end and a second or upper flange 15 which is formed adjacent to the boundary between the lower cylindrical portion 12*a* and the flared portion 12*b* and spaced apart from the first or lower flange 14 by a suitable distance. The first or lower flange 14 is in an air-tight contact with the inside wall surface 35*a* of the lower cylindrical portion 35 of the lower half 32 while the second or upper flange 15 is also in an air-tight contact with the inside surface of a cylindrical guide wall 37 extending vertically upwardly from the bottom of the upper large-diameter portion 36 coaxially thereof by a suitable height. Thus the movable tubular body 12 may slide in the vertically axial direction of the intake tube 3 with the first or lower and second or upper flanges 14 and 15 in air-tight contact with the inside wall surfaces thereof.

Figure 2:
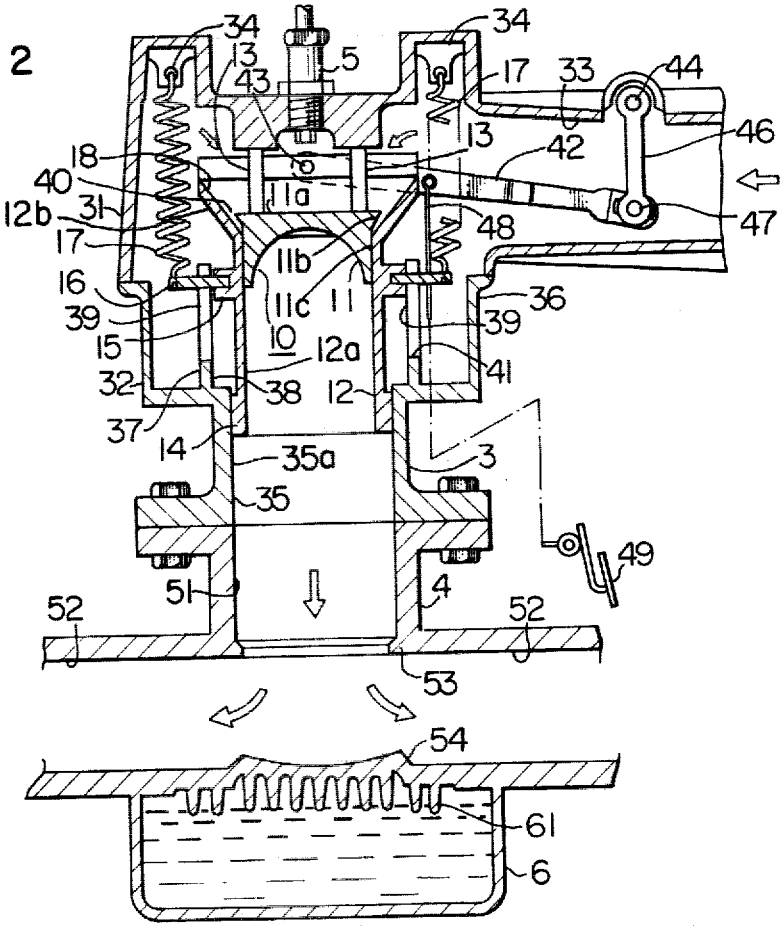
FIG. 2 is a longitudinal sectional view showing the essential parts of the intake system of FIG 1.

Four (only two is shown in FIG. 2) pins 16 radially outwardly extends from the second or upper flange 15 of the tubular body 12 and are equiangularly spaced apart from each other and extension coiled springs 17 are loaded between these pins 16 and the spring retainers or hangers 34 so that the tubular body 12 may be normally biased upwardly or toward the fuel injection valve 5. The guide pins 16 are slidably fitted into four equiangularly spaced vertical, elongated guide slots 39 formed through the cylindrical guide wall 37 so that not only the vertical stroke of the tubular body 12 may be limited but also the rotation of the tubular body 12 about its axis may be prevented.

It can be readily seen that an opening 40 is defined between the frustoconical metering surface 18 of the tubular body 12 and the stationary valve body 11 and is variable in opening area as the tubular body 12 is moved downward or upward. That is, as the tubular body 12 is forced to move down, the opening 40 is increased, and vice versa. Thus, the opening 40 constitutes a valve opening. The metering surface 18 has been described as being frustoconical, but it is to be understood that the metering surface 18 may have any suitable curvature or cross section so that the opening 40 varies its opening area as any desired function of the displacement or stroke of the tubular body 12. For instance, the opening area may be lineraly, stepwise or exponentially varied as the tubular body 12 moves up and down. At the uppr end of the stroke of the tubular body 12 which is limited by the upper ends of the guide slots 39, the metering surface 18 of the tubular body 12 is brought into very close contact with the outer circumferential wall 11*c* of the stationary valve body 11, whereby the intake pipe 3 may be completely closed. On the other hand, at the lower end of the stroke which is limited by the lower ends 41 of the guide slots 39, the opening 40 becomes widest. That is, the upper and lower ends of the stroke of the tubular body 12 correspond to the closed throttle and full throttle positions, respectively.

One end of a lever 42 is pivoted with a pivot pin 43 to the tubular body 12 adjacent the upper end thereof, while the other end is pivoted with a pivot pin 47 to one end of a crank 46 whose other end is pivoted with a pivot pin 44 to the air horn 33. The pivot pin 47 is fitted through an axially elongated slot formed at the other end of the lever 42 so that the distance between the pivot pins 43 and 47 may be changed as needed. One end of a wire 48 is jointed to the lever 42 at a point between its pivot pins 43 and 47, while the other end of the wire is operatively connected to a throttle control means such as an accelerator pedal 49.

When a driver depresses the accelerator pedal 49, the wire 48 pulls down the lever 42 so that the tubular body 12 is caused to move downwards against the bias springs 17, but when the driver releases the accelerator pedal 49, thus releasing the wire 48, the tubular body 12 returns upwards under the forces of the bias springs 17.

At the lower end of the inlet passage 51 of the intake manifold 4 where the inlet passage 51 meets a distribution passage 52 of the intake manifold 4, an annular projection or flange 53 is radially inwardly extending by a suitable distance and the upper edge of the flange 53 is beveled at an angle greater than 15°. This annular flange 53 may be cut off at several points.

In the heater 6 a plurality of heat-exchanging fins 61 are extended from the rear surface of a "hot spot" projection 54 raised slightly in the distribution passage 52 of the intake manifold 4 in opposed relationship with the inlet passage 51 so that the heat of the cooling water which is circulating through the heater 6 may be efficiently carried away to the "hot spot" projection 54. Instead of the cooling water, the exhaust gases may flow through the heater 6 or the "hot-spot" projection 54 may be directly heated by an electric heater.

Next the mode of operation of the first embodiment with the above construction will be described. When the driver depresses the accelerator pedal 49 to pull the wire 48, the tubular throttle body 12 is caused to move down against the forces of the bias springs 17 as described hereinabove so that the opening 40 between the tubular throttle body 12 and the stationary valve body 11 widens accordingly. The combustion air flows through the air cleaner 2, the intake pipe 3 and the intake manifold 4 into the engine 1. The fuel injection valve 5 injects the fuel in such a quantity that when the injected fuel is mixed with the air which is flowing through the intake pipe 3 at a flow rate dependent on the stroke or position of the tubular body 12, the air-fuel mixture may be prepared whose air-fuel ratio is optimum to the operating conditions of the engine 1. The injected fuel impinges against the stationay valve body 11 which is spaced apart from the tip of the fuel injection valve 5 by a predetermined distance and forms a thin film over the top flat surface 11*a* of the stationary valve body 11. The formed thin film expands radially outwardly, and when it leaves from the peripheral edge of the top surface 11*a* of the body 11, it is atomized by the air flowing at high velocities through the opening 40 and then vaporized, whereby the combustion mixture with an optimum air-fuel ratio may be obtained. The fuel and air are further uniformly mixed as the mixture flows along the frustoconical metering surface 18 toward the axis of the tubular body 12 and axially into the intake manifold 4 through the combustion mixture passage in the intake pipe 3 and the inlet passage 51. From the intake manifold 4 the combustion mixture is charged into the cylinders of the engine 1 as is well known in the art. The combustion mixture with an optimum, uniform air-fuel ratio may ensure the higher performance of the engine and the minimum emission of pollutants such as HC (hydrocarbons).

The geometrical relationship between the fuel injection valve 5 and the stationary valve body 11 remains unchanged independent of the operating conditions of the engine 1 so that the fuel injected may be uniformly distributed over the top surface 11*a* of the valve body 11 and consequently non-uniform distribution of the air-fuel mixture can be completely avoided in the intake pipe 3. As The fuel distributed over the whole top surface 11*a* of the stationary valve body 11 is atomized, fuel particles flow from the frustoconical metering surface 18 toward the axis of the tubular body 12 so that non-uniform distribution of the fuel particles into the combustion air may be avoided. In addition, the fuel which adheres to the inside wall surfaces 35*a* of the lower small-diameter cylindrical portion 35 of the lower half 32 of the intake pipe 3 may be reduced in quantity drastically and consequently the formation of a fuel film thereover may be minimized. A very small quantity of fuel flows down the inside wall surface in the form of a film into the intake manifold, but the fuel film is separated by the projection or projections 53 at the lower end of the inlet passage 51 from the inside wall surface thereof and falls upon the "hot spot" projection 54 so that the fuel is vaporized again and entrained in the air-fuel mixture into the cylinders of the engine 1. Thus the air-fuel mixture can be charged into the cylinders in an optimum and more uniform air-fuel ratio.

Although the opening 40 varies its opening area dependent upon the displacement of the tubular body 12, a ratio of the opening area of the opening 40 to the area of the entire outer circumferential wall 11*c* of the stationary valve body 11 is small when the displacement of the tubular body 12 is small so that the opening 40 is formed only along part of the outer circumferential wall 11*c* of the valve body 11. Thus the air-fuel mixture fed to the engine 1 is slowly varied in amount in spite of the displacement of the movable tubular body 12 to facilitate fine control of the amount of the air-fuel mixture fed to the engine 1.

Figure 8:
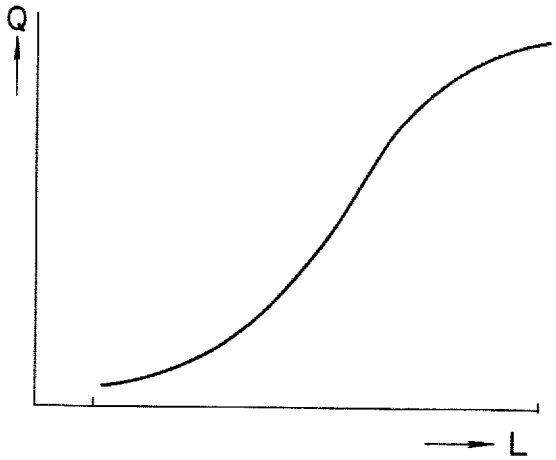
FIG. 8 is a plot of an amount of mixture versus a displacement of the movable tubular body.

On the other hand, a ratio of the opening area of the opening 40 to the area of the entire outer circumferential wall 11*c* of the stationary valve body 11 becomes large for the opening 40 is formed along the entire periphery of the circumferential wall 11*c* when the displacement of the tubular body 12 is large. Thus with the arrangement of the present invention, the requirement for large amount of the air-fuel mixture during high speed operation of the engine can be satisfactorily met. FIG. 8 shows a plot of a supply Q of the air-fuel mixture versus the displacement L of the movable tubular body 12, of which curve is suitable for control.

While in the embodiment described above, the fuel supply means has been described as comprising a fuel injection valve, a conventional carburetor may be used instead of the fuel injection valve. While the movable tubular body has been described and shown as being cylindrical-shaped in the embodiment described above, the shape of the tubular body can be varied depending upon the requirement of the engine with the shape of the stationary valve body 11 vaired correspondingly.

As described above, according to the present invention, complete atomization of fuel can be effected and localized concentrations of the fuel in the entraining air can also be eliminated, so that degradation of engine performance and an increase in emission of pollutants due to lack of uniformity of air-fuel mixture distribution can be prevented and control of the amount of air-fuel mixture fed to the engine is improved.

What is claimed is:

1. In an intake system for internal combustion engines, said intake system including an intake pipe, fuel supply means for charging fuel into said intake pipe so as to form an air-fuel mixture, and intake manifold for distributing the air-fuel mixture into cylinders of said engine, and a throttling system incorporated in said intake pipe between said fuel supply means and said intake manifold for controlling the flow rate of the air-fuel mixture to be delivered to said intake manifold, said throttling system comprising:

a stationary valve body spaced apart from said fuel supply means by a predetermined distance in opposed relationship therewith and having a lower indented surface;

a movable hollow valve body containing therewithin said stationary valve body, and having a cone-shaped upper portion and an outer wall surface, a part of which is slidably closely engaged with an inner wall surface of said intake pipe, and an inner wall surface which cooperates with said lower indented surface of said stationary valve body to define a valve opening in communication with said intake pipe;

said movable hollow valve body being movable relative to said stationary valve body in an axial direction of the latter to vary a ratio of the opening area of said valve opening to the area of the entire outer circumferential wall surface of said stationary valve body dependent upon the displacement of said movable hollow valve body, thereby controlling an amount of the air-fuel mixture charged into the cylinders of the engine wherein a portion of said stationary valve body is disposed inside said cone-shaped upper portion of said movable hollow valve body.

2. An intake system as set forth in claim 1, further comprising a plurality of springs for imparting an axial force to said movable hollow body.

3. An intake system as set forth in claim 1, further comprising rod members for supporting said stationary valve body.

4. An intake system as set forth in claim 1 wherein said intake manifold comprises a substantially ringshaped projection at the portion thereof where the flow of air-fuel mixture makes a turn.

5. An intake system as set forth in claim 1, further comprising guide means disposed at the outer wall of said movable hollow valve body for guiding axial movement of said movable hollow valve body.

6. An intake system as set forth in claim 1 wherein said stationary body comprises a tapered surface and an outer cylindrical-shaped peripheral wall which slidably fits said inner wall surface of said movable hollow valve body.

7. An intake system as set forth in claim 6 wherein said outer peripheral wall of said stationary valve body is tooth-shaped at its edge portion.

8. An intake system as set forth in claim 1, wherein said stationary valve body has a top surface space apart from said fuel supply means so that fuel from said fuel supply means impinges against said top surface and diverges outwardly to the edge of said top surface whereby fuel is atomized by air as said fuel leaves said top surface.

9. An intake system as set forth in claim 8 wherein the surface of said stationary valve body opposing said fuel supply means is flat.

10. An intake system as set forth in claim 1 wherein said movable hollow valve body has a tapered inclined surface, and said stationary valve body has an outer circumferential wall, of which axial length varies angularly to vary a ratio of the opening area of said valve opening defined by said tapered inclined surface of the movable hollow valve body and said outer circumferential wall of the stationary valve body to a surface area of the outer circumferential wall of the stationary valve body dependent upon the displacement of the movable hollow valve body.

11. An intake system as set forth in claim 1 wherein the lower edge of the outer circumferential wall of the stationary valve body is toothed.

12. An intake system as set forth in claim 11 wherein said teeth at the lower edge of the stationary valve body are sinusoidal-waved.

13. An intake system as set forth in claim 1, 10, 11 or 12 wherein said fuel supply means is a fuel injection valve.

14. An intake system as in claim 1, 10 or 11 wherein said stationary valve body includes a cone-shaped upper portion, said stationary valve body being disposed inside said cone-shaped upper portion of said movable hollow valve body.

* * * * *